US005943956A

United States Patent [19]

Marquez et al.

[11] Patent Number: 5,943,956

[45] Date of Patent: Aug. 31, 1999

[54] CLEANING SYSTEM FOR BLANKET CYLINDERS

[75] Inventors: Manuel E. Marquez, Milpitas, Calif.; Boris Rozenfeld, Aurora; Peter Nemeth, Englewood, both of Colo.

[73] Assignee: Machine Design Service, Inc., Denver, Colo.

[21] Appl. No.: 09/040,923

[22] Filed: Mar. 18, 1998

Related U.S. Application Data

[63] Continuation-in-part of application No. 08/825,233, Mar. 18, 1997.

[51] Int. Cl.[6] ..... B41F 35/00

[52] U.S. Cl. ..... 101/425; 101/423

[58] Field of Search ..... 101/423, 425

[56] References Cited

U.S. PATENT DOCUMENTS

| | | | |
|---|---|---|---|
| 3,983,813 | 10/1976 | Tani | 101/425 |
| 4,499,827 | 2/1985 | Takeuchi et al. | 101/425 |
| 4,757,763 | 7/1988 | MacPhee et al. | 101/425 |
| 4,922,820 | 5/1990 | Grossmann et al. | 101/425 |
| 5,020,433 | 6/1991 | Jeschke et al. | 101/423 |
| 5,086,701 | 2/1992 | Gasparrini et al. | 101/425 |
| 5,138,945 | 8/1992 | Lee et al. | 101/425 |
| 5,148,746 | 9/1992 | Fuller et al. | 101/425 |
| 5,277,111 | 1/1994 | Uribe et al. | 101/425 |
| 5,309,836 | 5/1994 | Takeuchi | 101/425 |
| 5,379,695 | 1/1995 | Rieth et al. | 101/425 |
| 5,515,782 | 5/1996 | Ebina et al. | 101/423 |

*Primary Examiner*—Ren Yan
*Assistant Examiner*—Leslie J. Grohusky
*Attorney, Agent, or Firm*—W. Scott Carson

[57] ABSTRACT

A dry cleaning system for removing dust and lint on the fly from blanket cylinders in offset printing presses. The cleaning system includes a relatively small brush mounted for rotation about an axis substantially perpendicular to the rotational axis of the blanket cylinder. In operation, the brush can be reciprocally moved across the surface of the blanket cylinder and selectively moved into and out of contact with the blanket cylinder. The contact pressure of the brush is pneumatically controlled to maintain a predetermined, set pressure and the brush automatically retracts should the pressure source fail. The system can be operated to clean the entire width of the blanket cylinder or only the portion of it actually being used to print. A vacuum pickup is included with its separately mounted housing and the entire cleaning system is carried on a unitary support structure that is removably secured at its ends for quick and easy installation and removal.

21 Claims, 15 Drawing Sheets

Fig. 4
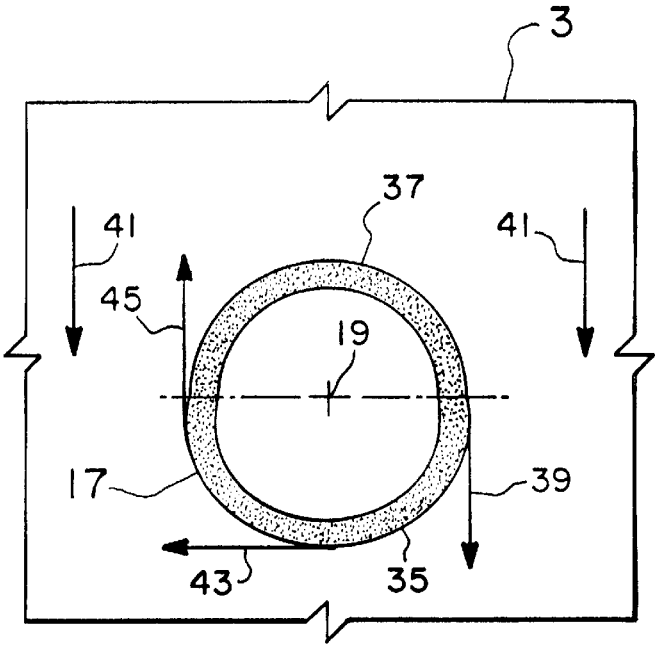
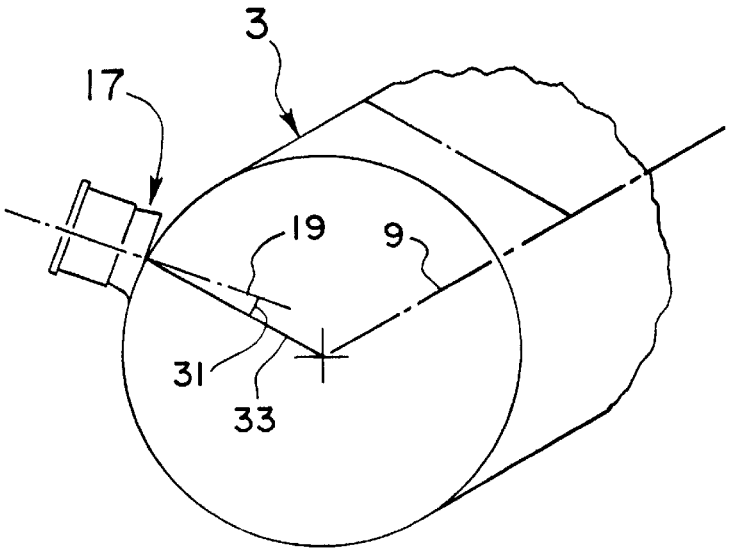
Fig. 5

Fig. 12
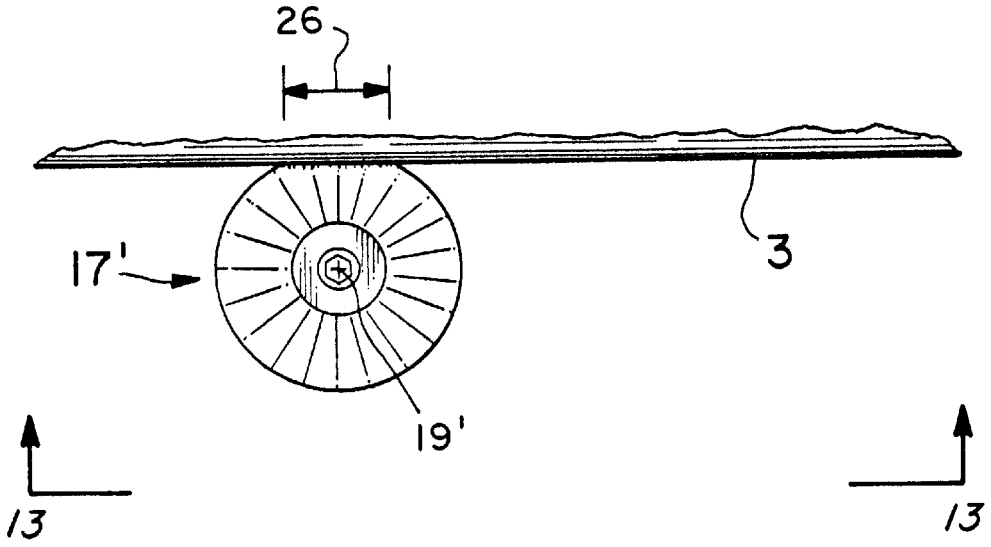
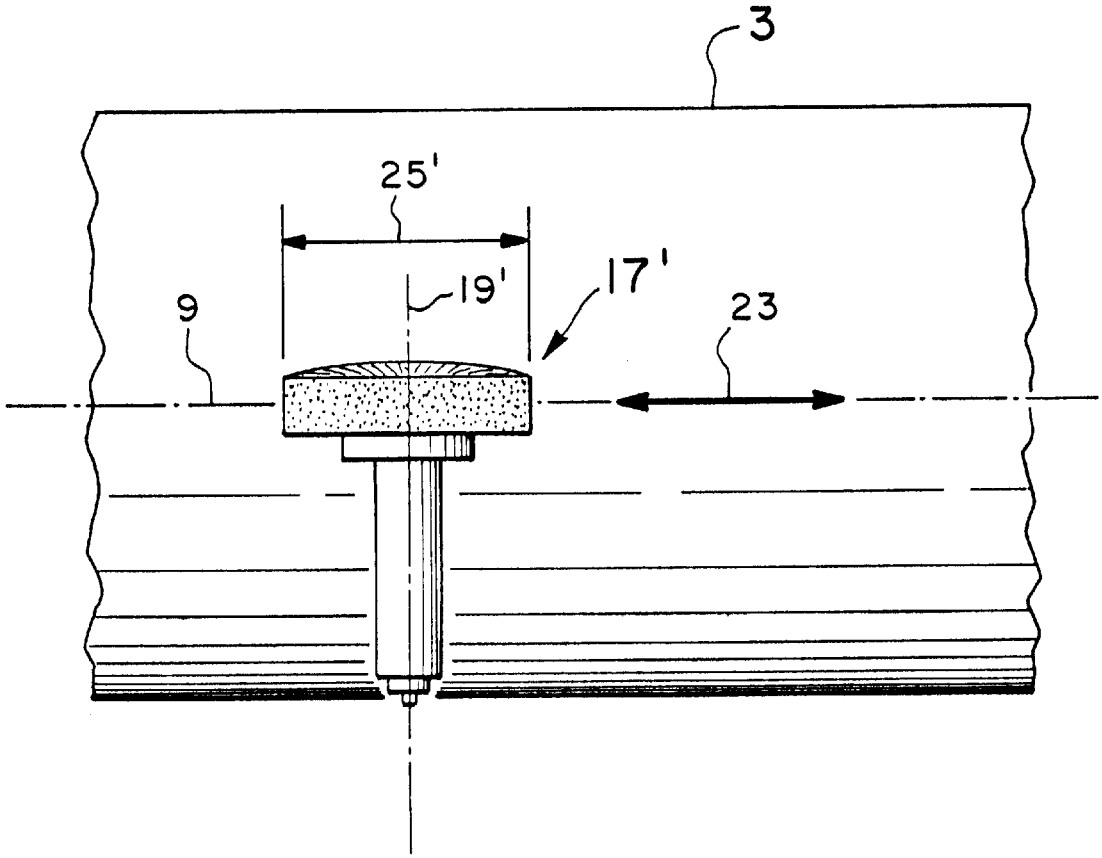
Fig. 13

3
17
2
21
19"
24
17
17
22
22
28
20
10
20
10
12
12
24'
21
30
19"
26
V
18
R
16
14
73'
CONTROLLER
A

Fig. 21
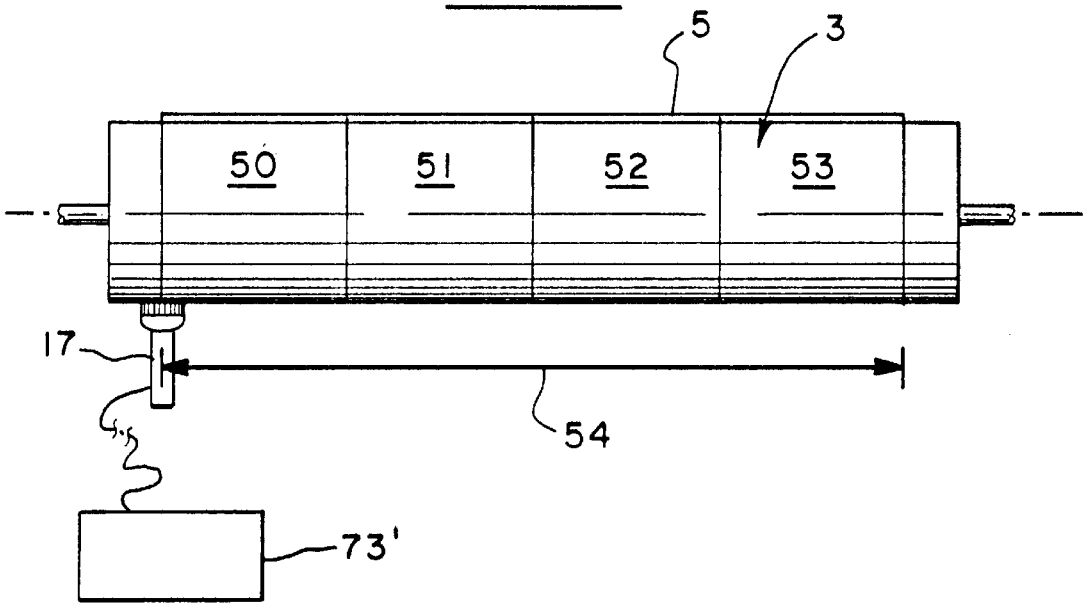
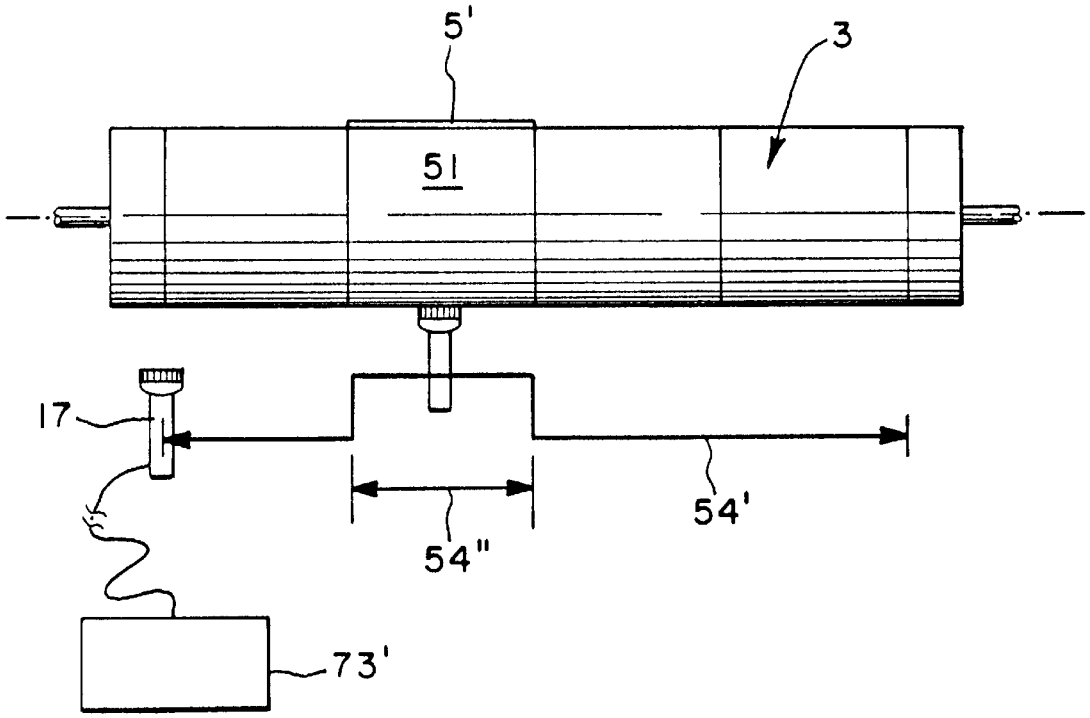
Fig. 22

CLEANING SYSTEM FOR BLANKET CYLINDERS

RELATED APPLICATION

This application is a continuation-in-part of U.S. patent application Ser. No. 08/825,233 filed Mar. 18, 1997.

BACKGROUND OF THE INVENTION

1. Field of the Invention

This invention relates to the field of cleaning systems for blanket cylinders in offset printing presses such as in newspaper facilities.

2. Discussion of the Background

Offset printing presses such as in newspaper facilities typically have plate cylinders that transfer the image to blanket cylinders which in turn print the image on each side of a paper web. A common problem in such arrangements is that dust and lint from the paper web and general environment of the press tend to collect on the blanket cylinders. This debris then mars the quality of the final image being transferred to each side of the paper web from the blanket cylinders. Known methods are available for cleaning the surfaces of the blanket cylinders but they are for the most part bulky and expensive and often require the use of liquids and chemicals. In the cramped quarters of a press and in particular those at newspaper facilities, the sheer size and bulk of such cleaning arrangements and their support structure are major drawbacks as they make it very difficult to inspect the operation of the press and to make normal and emergency repairs and maintenance. Additionally, most existing cleaning systems require that the press be slowed down or even stopped and cannot clean the blanket cylinders on the fly with no interruption of the press run.

In this light, the present invention was developed. With it, a compact and relatively inexpensive system is provided for mechanically cleaning the surfaces of the blanket cylinders on the fly and without the need for liquids or chemicals.

SUMMARY OF THE INVENTION

This invention involves a dry cleaning system for removing dust and lint on the fly from blanket cylinders in offset printing presses such as used in newspaper facilities. Because it operates on the fly, there is no need to stop or otherwise interrupt the press run to perform the cleaning.

The cleaning system includes a relatively small and inexpensive brush for each blanket cylinder. The brush is mounted for rotation about an axis substantially perpendicular to the rotational axis of the blanket cylinder and can be reciprocally moved across the surface of the blanket cylinder. In the preferred embodiment, the rotational axis of the brush is tilted at a slight acute angle to the axis of the blanket cylinder. Consequently, at any one time, only a portion of the brush contacts the surface of the blanket cylinder and the remaining portion is spaced from it. The rotation of the brush results in its bristles rubbing against the surface of the blanket cylinder in multiple directions for an enhanced cleaning effect. Additionally, the movement of the brush across the surface of the blanket cylinder creates a sweeping or wiping motion of the dust and lint in the direction of movement of the brush across the blanket cylinder.

The cleaning system of the present invention also includes an arrangement to move the brush into and out of contact with the blanket cylinder. It further includes a control for the overall operation that can automatically and periodically activate the cleaning operation based on a predetermined number of revolutions of the blanket cylinder and/or a predetermined time interval. The control can also be manually activated and de-activated by the operator as desired. The control preferably monitors normal operating parameters of the press (e.g., the rate of revolution of the blanket cylinder, tension in the paper web) and upon sensing a problem or deviation from the normal operation of the press (e.g., break in the paper web), the control automatically returns the brush to its home or out-of-the-way position. The cleaning system can also be provided with a vacuum pickup if desired to entrain away and collect the dust and lint being removed from the blanket cylinder.

The cleaning system in another embodiment can be selectively operated to clean the full width of the blanket cylinder or only the portion of it actually being used to print. In this preferred embodiment, the contact pressure of the brush is pneumatically controlled to maintain a predetermined, set pressure as the brush is moved across the surface of the blanket cylinder. In the case of any failure of the pressure source, the brush is automatically retracted away from the surface of the blanket cylinder. The vacuum housing in this embodiment is separately mounted and can be selectively moved toward and away from the blanket cylinder independently of the movement of the brush. The entire cleaning system in this embodiment is preferably carried on a unitary support structure that is removably secured at its ends to the side walls of the press for quick and easy installation and removal.

BRIEF DESCRIPTION OF THE DRAWINGS

FIG. 4 is a simplified view taken along line 4—4 of FIG. 2 showing the cleaning motion of the brush.

FIG. 5 is a schematic illustration of the manner in which the rotational axis of the brush is tilted at a small acute angle to a radius of the blanket cylinder.

FIG. 12 is a view of the alternate brush design taken along line 12—12 of FIG. 11.

FIG. 13 is a view taken along line 13—13 of FIG. 12.

FIG. 21 illustrates the preferred mode of operation of the cleaning system when a full web of paper is being printed.

FIG. 22 illustrates alternative operations of the cleaning system when less than a full web of paper is being printed.

DETAILED DESCRIPTION OF THE PREFERRED EMBODIMENTS

Figure 1:
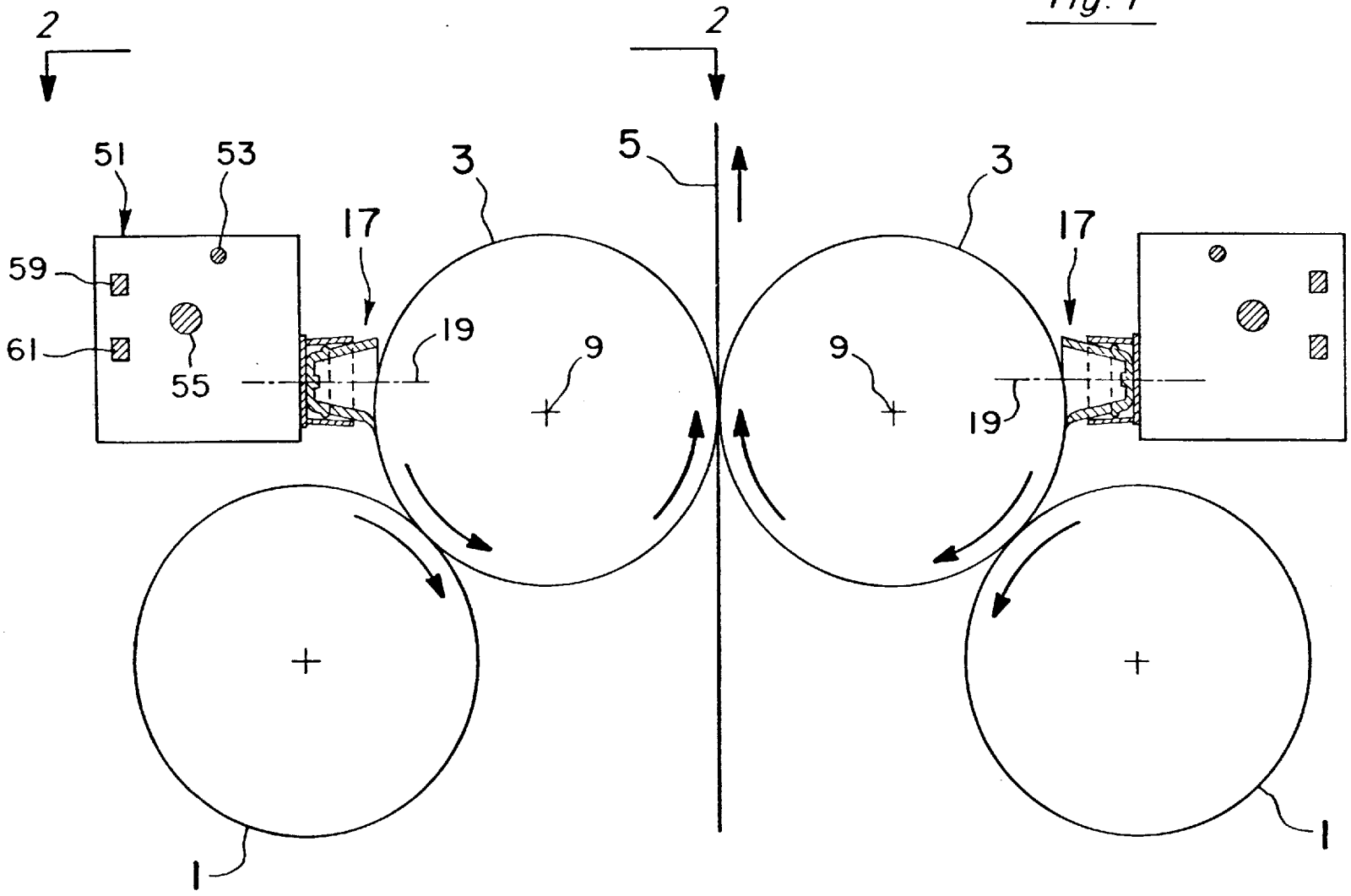
FIG. 1 schematically illustrates a common offset printing press arrangement such as in a newspaper facility with the addition of the cleaning system of the present invention.
Figure 2:
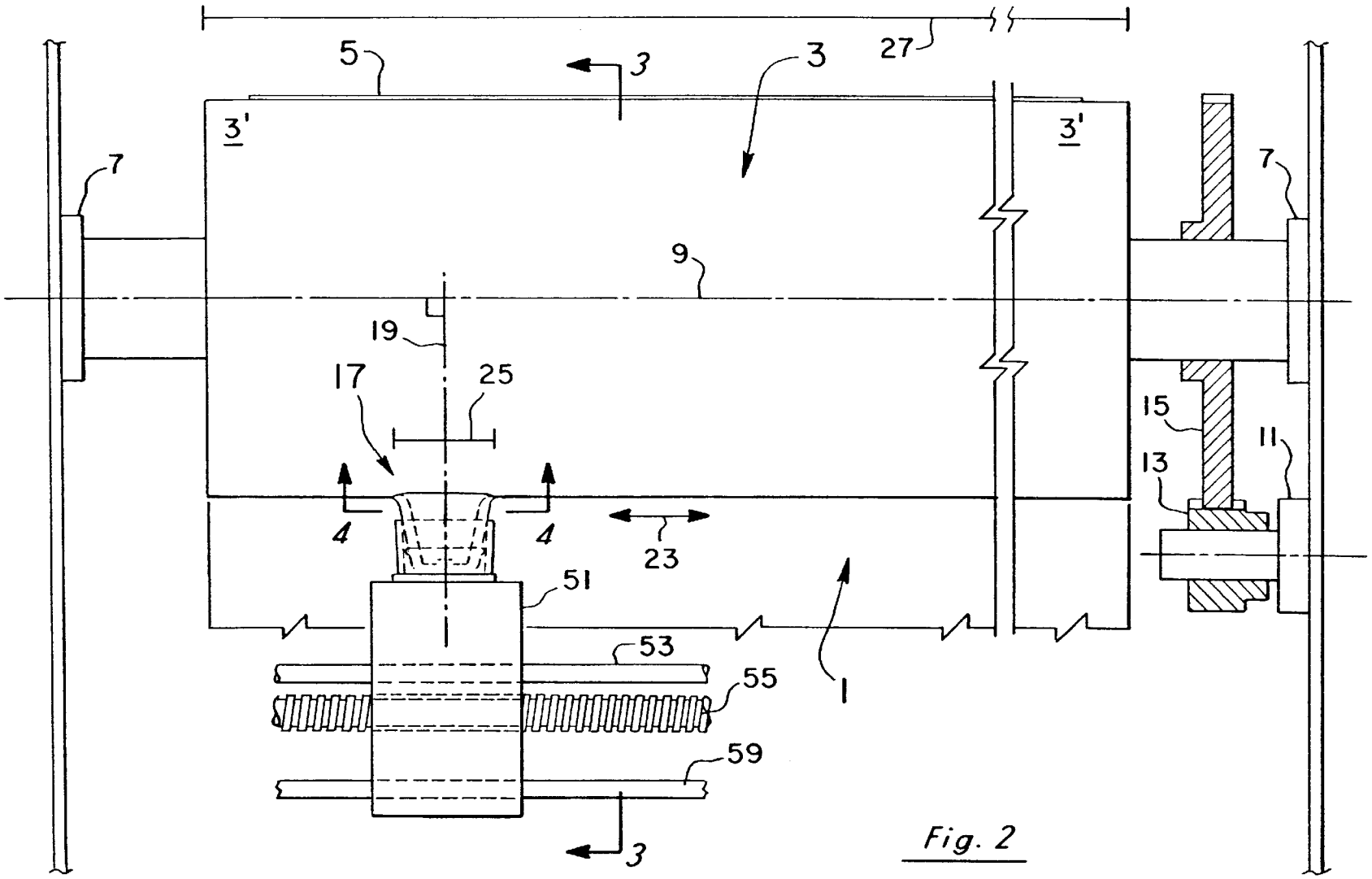
FIG. 2 is a view taken along line 2—2 of FIG. 1.

FIG. 1 schematically illustrates a common offset printing press arrangement such as used in newspaper facilities. In it, the images are being transferred from the plate cylinders 1 to the blanket cylinders 3 and from there to each side of the paper web 5. Each blanket cylinder 3 as shown in FIG. 2 is mounted at 7 for rotation about its longitudinal axis 9 and can be driven in any number of manners including the simple arrangement of motor 11 and gears 13 and 15 illustrated in FIG. 2. As discussed above, a common problem with such offset printing presses is that dust and lint from the paper web 5 and general environment of the press tend to collect on the blanket cylinders 3. This debris then mars the quality of the final images being transferred from the blanket cylinders 3 to each side of the paper web 5. In this light, the present invention was developed and includes a cleaning system for removing such dust and lint from the blanket cylinder 3. The system is preferably a dry one meaning no liquids or chemicals are used or needed. Additionally, it is operable on the fly to clean the blanket cylinder 3 without interrupting the run of the press.

The cleaning system of the present invention includes a brush 17 for each blanket cylinder 3 (see FIG. 1). Each brush 17 is mounted for rotation about an axis 19 which is substantially perpendicular to the longitudinal axis 9 of the blanket cylinder 3 as illustrated in FIGS. 1 and 2. In operation, each brush 17 is rotated about its axis 19 by, for example, an air-driven motor such as 21 in FIG. 3. Additionally, each brush 17 can be reciprocally moved back and forth across the surface of the blanket cylinder 3 along the path 23 (see FIG. 2). Path 23 as shown is substantially parallel to the longitudinal axis 9 of the blanket cylinder 3.

In contrast to previous systems, the cleaning system of the present invention uses a relatively small, inexpensive, and unintrusive brush 17 and support structure for it. In the cramped quarters of a printing press, this small size is very important in that the brush 17 and other parts of the cleaning system do not block or impede access to the blanket cylinder 3 by the operator for inspection and repairs. The brush 17 as illustrated in FIG. 2 is preferably about 3 to 4 inches across at 25. In comparison, the overall length 27 of the blanket cylinder 3 is commonly about 50–60 inches with a diameter of 14½ inches. Regardless of the exact dimensions of the brush 17 and blanket cylinder 3, the brush 17 in the preferred embodiments extends along the longitudinal axis 9 of the blanket cylinder 3 only a fraction and preferably only a small fraction (e.g., 1/10) of the length 27 of the blanket cylinder 3.

Figure 3:
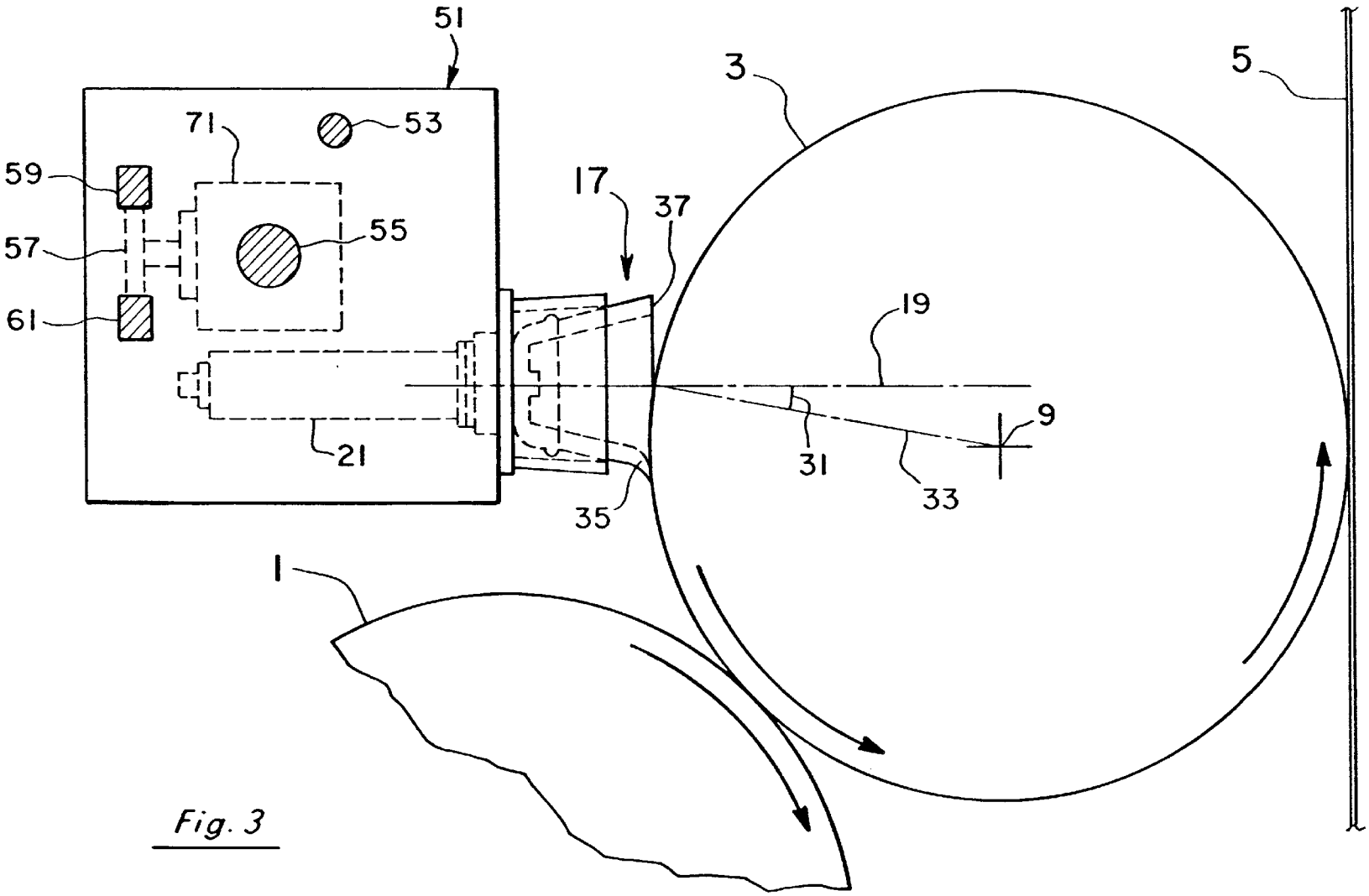
FIG. 3 is a view taken along line 3—3 of FIG. 2 and line 3—3 of FIG. 6 illustrating the brush of the present invention in its contact position with the surface of the blanket cylinder.

In the preferred embodiment as seen in FIG. 3, the axis 19 of the rotating brush 17 is actually inclined, tilted, or cocked at a small acute angle 31 (e.g., 10 degrees) to the radius 33 of the blanket cylinder 3. The projection of the brush axis 19 onto the blanket cylinder axis 9 in FIG. 2 is still preferably substantially 90 degrees. However, this small tilt of FIG. 3 results in the brush 17 at any one time having an annular, first portion 35 (see FIGS. 3 and 4) in contact with the surface of the blanket cylinder 3. The remaining annular portion 37 is then spaced from contact with the surface of blanket cylinder 3. In this regard as also best seen in FIGS. 3 and 4, the annular contact portion 35 of the brush 17 tends to flare out relative to the rotational axis 19 of the brush 17 and relative to the remaining brush portion 37. The brush portions or annular segments 35 and 37 as seen in FIG. 4 are immediately adjacent one another about the rotational axis 19 of the brush 17 and extend substantially equally (i.e., 180°) about the axis 19. The tilting or cocking of the brush axis 19 is also schematically illustrated in FIG. 5. As shown in FIG. 5, the brush axis 19 is at a slight acute angle 31 (e.g., 10°) to a plane formed by axis 9 of the blanket cylinder 3 and a radius 33 of the blanket cylinder 3. The radius 33 as illustrated intersects the brush axis 19 at the surface of the blanket cylinder 3.

The brush 17 is preferably just a cylindrical or slightly conical one as illustrated but could be of other designs including with bristles completely filling the cross section. In the preferred design, the bristles (e.g., flexible nylon) of the brush 17 extend along and about the brush axis 19 to form the annular shape of FIG. 4 with the angular segment or portion 35 at any one time contacting the surface of the blanket cylinder 3. FIG. 4 also illustrates a unique feature of the present invention in that the orientation of the rotational axis 19 of the brush 17 results in the bristles of the brush 17 striking and rubbing across the surface of the blanket cylinder 3 in multiple directions. That is and as shown in FIG. 4, the tips or free end portions of the bristles of the brush 17 move with and parallel at 39 to the rotational direction 41 of the surface of the blanket cylinder 3. At 43, the free end portions or tips of the bristles are then moving substantially perpendicular to the rotational direction 41 of the blanket cylinder 3 and at 45, they are again parallel to the rotational direction 41 but moving in the opposite direction to it. These multi-directional movements of the end portions or tips of the bristles of the brush 17 (at 39, 41, and 43 and at positions therebetween) result in a very thorough cleaning action on the surface of the blanket cylinder 3. This is particularly true at the speeds involved (e.g., the four to five inch diameter brush 17 rotating at about 500–4000 or more revolutions per minute and the 14½ inch diameter blanket cylinder 3 rotating at about 20,000–80,000 or more revolutions per hour). Additionally, the lateral movement of the entire brush 17 across the blanket cylinder 3 along path 23 in FIG. 2 creates a sweeping or wiping motion of the paper dust and lint laterally across the blanket cylinder 3.

Figure 6:
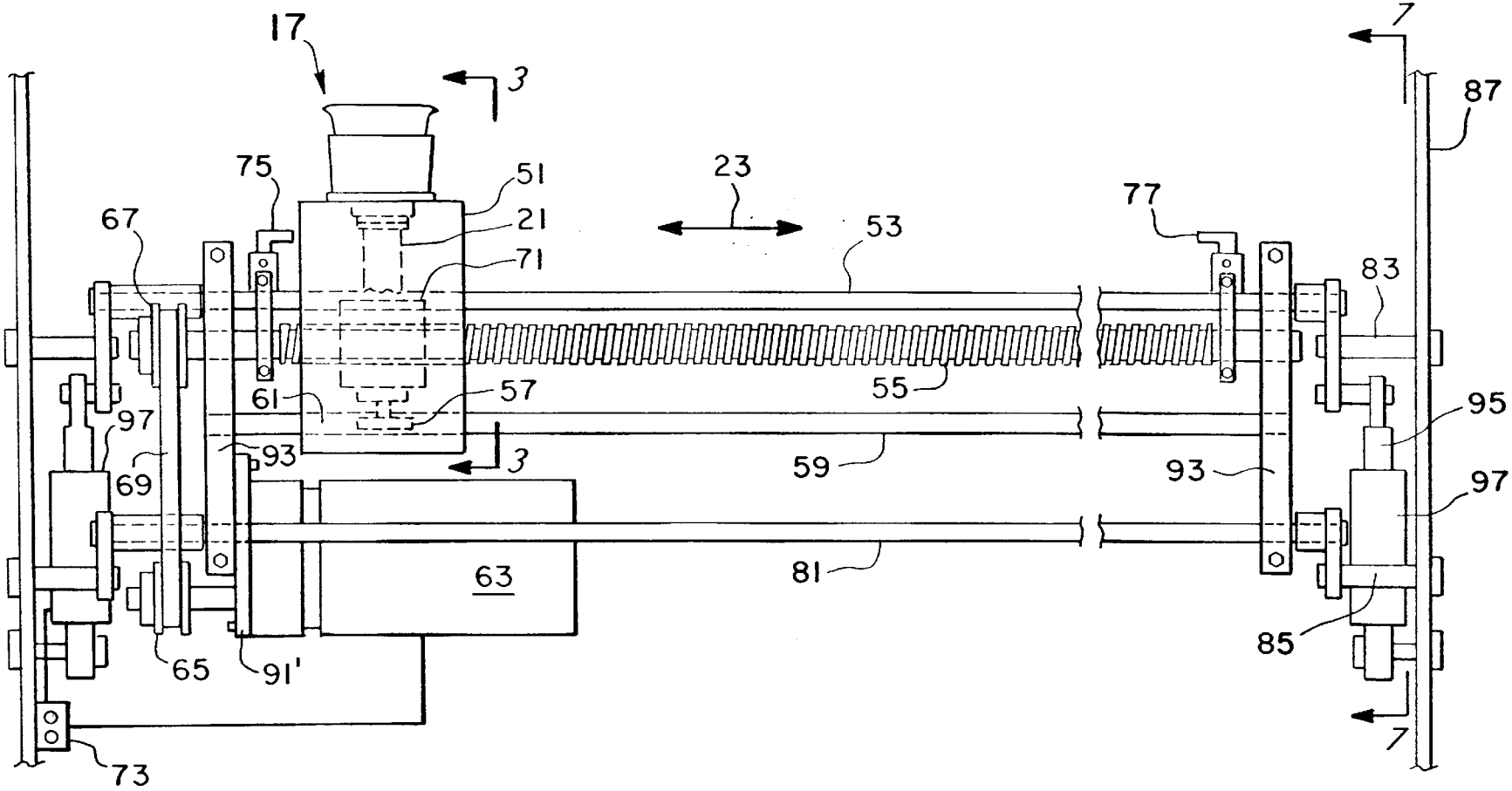
FIG. 6 is a simplified top plan view of the cleaning brush and its support structure.
Figure 7:
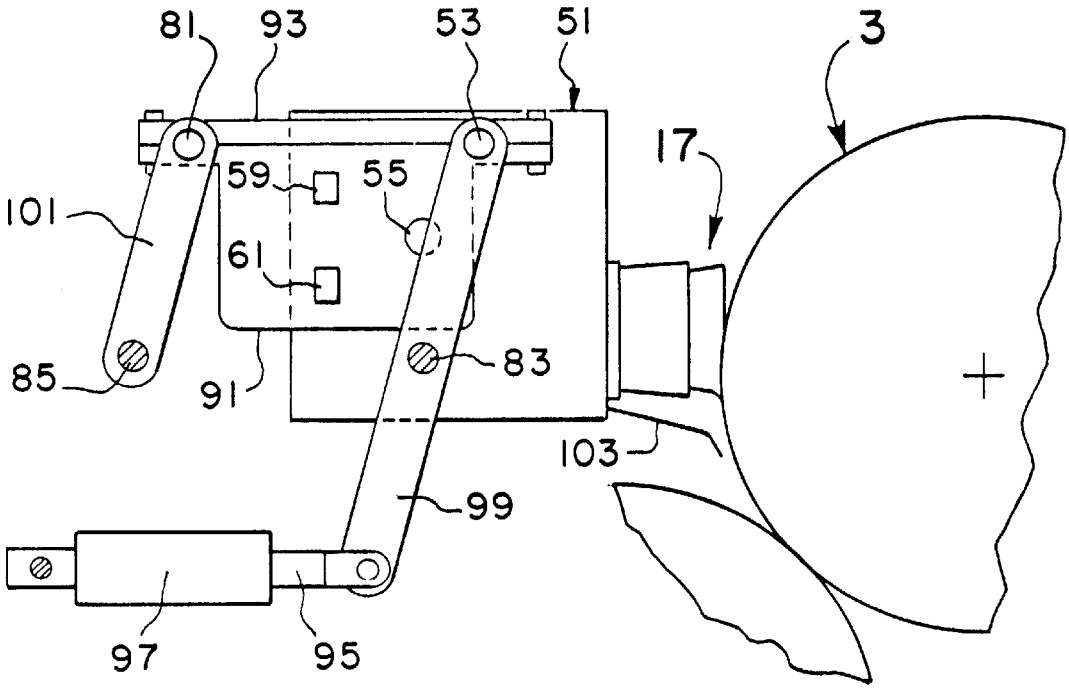
FIG. 7 is a view taken along line 7—7 of FIG. 6 illustrating the brush in its contact position with the blanket cylinder.
Figure 8:
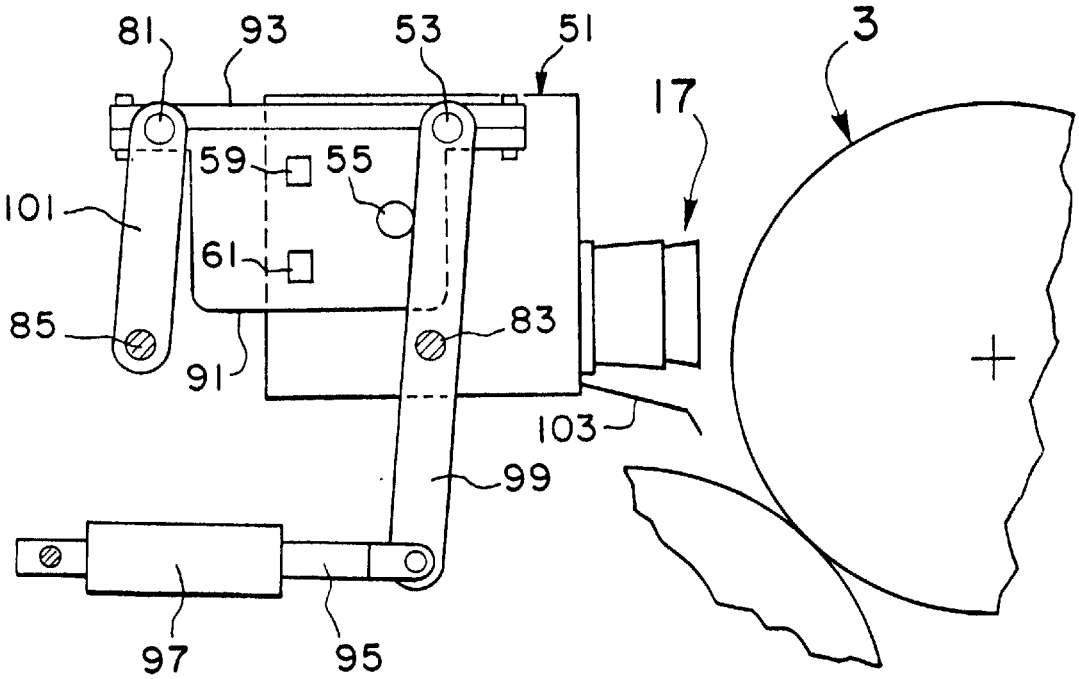
FIG. 8 is a view similar to FIG. 7 but with the cleaning brush moved away from contact with the blanket cylinder.

FIG. 6 illustrates a manner in which the brush 17 can be reciprocally moved along its path 23 across the blanket cylinder. FIG. 7 and 8 then illustrate one manner in which the brush 17 can be selectively moved into and out of contact with the surface of the blanket cylinder 3. Referring again to FIG. 6 (in which the plate and blanket cylinders have been deleted for clarity), the brush 17 can be mounted in any number of ways to reciprocally move along its path 23. As illustrated, one such manner is simply to mount the brush 17 and its air-driven motor 21 in a housing 51. The housing 51 in turn is supported on crossbar 53 (see also FIG. 3) and screw bar 55. Additionally, housing 51 has a cam follower 57 in FIGS. 3 and 6 mounted between upper and lower crossbars 59 and 61.

In operation, motor 63 (e.g., electric or pneumatic) on the left side of FIG. 6 operates to selectively turn the screw bar 55 through side gears 65 and 67 and connecting timing belt 69. The brush housing 51 is then selectively moved along the path 23 as the screw bar 55 turns in the housing nut 71 (see FIGS. 3 and 6). The cam follower 57 as shown contacts the upper and lower crossbars 59 and 61 in FIG. 3 to keep the housing 51 from turning with the screw bar 55. When activated, the housing 51 with its brush 17 can then be reciprocally moved between the proximity switches 75 and 77 in FIG. 6, which switches are substantially aligned with the end portions 3' of the blanket cylinder 3. In the preferred embodiment, an overall control means 73 such as in FIG. 6 is provided at a readily accessible position on or remote from the press. This control means 73 can be set to simply periodically move the brush 17 from a home position (e.g., the left and/or right side in FIG. 6) across to the other side and stop or move reciprocally from, for example, 75 to 77 and back where it would stop or any other desired run pattern over the blanket cylinder.

Whether the brush 17 is caused to make a single pass between switches 75 and 77 and stop, reciprocal passes, or variations thereof, such operation is preferably coordinated with the revolutions of the blanket cylinder 3 to thereby automatically clean it every predetermined number of revolutions (e.g., every 70,000 revolutions) and/or on a timed interval (once every hour). Preferably, the control means 73 also has a manual mode in which the operator can at any time commence (or halt) a cleaning pass or passes. Additionally, the control means 73 monitors and senses normal operational parameters of the press (e.g., rotational rate of the blanket cylinder 3, normal tension in the paper web 5). When a deviation in one or more of the normal operating parameters is sensed (e.g., lowered rotational rate of the blanket cylinder 3, break in the paper web 5), the control means 73 then automatically activates the brush 17 to move or return to an end or home position (e.g., adjacent either end of the blanket cylinder 3 at either of the proximity switches 75, 77). The brush 17 thus automatically seeks its out-of-the-way, home position in emergencies to provide easy access to the blanket cylinder 3. A manual return is also included in the control means 73.

Regardless of whether the brush 17 is set to make a single pass between proximity switches 75 and 77, reciprocal passes, partial passes, or any other variation, the brush 17 can be selectively moved away from contact with the surface of the blanket cylinder 3 in any number of manners including the parallelogram arrangement of FIGS. 7 and 8. In this arrangement, the brush 17 and its housing 51 are supported on crossbars 53, 55, 59, and 61. Crossbars 53 and 81 in FIG. 7 are then part of the parallelogram with the pins 83 and 85 that are fixedly supported in side wall 87. The ends of bars 55, 59, and 61 in FIGS. 7 and 8 are supported in flange 91 depending from cross brackets 93. When the piston 95 of cylinder 97 is advanced (compare FIGS. 7 and 8), linkage arm 99 pivots about pin 83 to pivot arm 101 about pin 85. This then moves bars 53 and 81 (as well as bars 55, 59, 61, housing 51, and brush 17) away from the blanket cylinder 3. Motor 63 on the left in FIG. 6 is supported on flange 91' which in turn is supported on a flange like 91 of FIG. 7 but depending from the left cross bracket 93 in FIG. 6. In this manner, motor 63 then moves with the parallelogram structure of FIGS. 7 and 8.

In the preferred embodiment, control means 73 in FIG. 6 automatically activates piston-cylinder 95, 97 at the commencement and end of a cleaning run by the brush 17 to move the brush 17 to and from the positions of FIGS. 7 and 8. This is true regardless of whether the run or pass of the brush 17 is simply one length of the blanket cylinder 3 and stop, across and back and stop, or variations thereof. The actual cleaning time, for example, to reciprocally move the brush 17 across and back over the blanket cylinder is relatively short (e.g., 90 seconds). Consequently, the brush 17 for the most part is always at its home position (e.g., out of the way on one side or end of the blanket cylinder 3 in the retracted mode of FIG. 8). Additionally, the control means 73 preferably automatically moves the brush 17 to its retracted position of FIG. 8 and returns the brush 17 to its home position should an emergency occur (e.g., break in paper web 5). In this regard, a break in the paper web 5 could be sensed in any number of manners including by monitoring the tension in the web 5 or with a simple, pivoted limit switch 103 as illustrated in FIG. 7. That is, if the paper web 5 breaks, it tends to rapidly wrap around the blanket cylinder 3 and will eventually contact and lift or pivot the spring biased switch 103 to signal an emergency.

Figure 9:
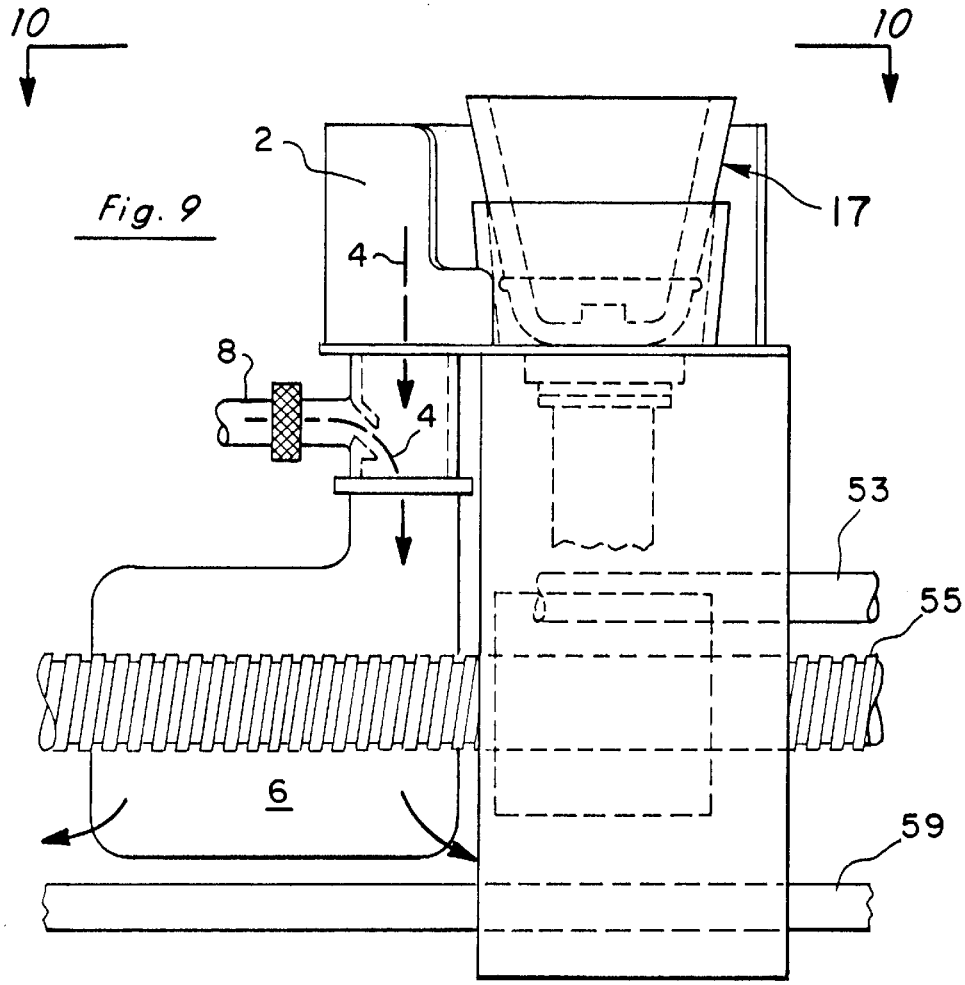
FIG. 9 illustrates the basic cleaning system of the present invention with a vacuum pickup added for the removed dust and lint.
Figure 10:
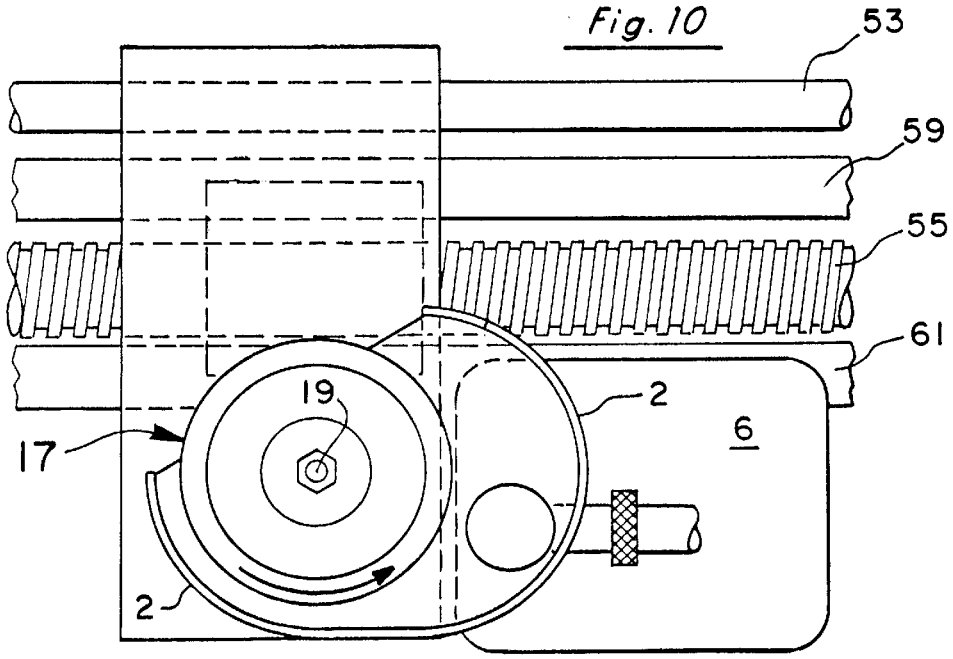
FIG. 10 is a view taken along line 10—10 of FIG. 9.

A vacuum pickup can also be included if desired as illustrated in FIGS. 9 and 10. In this embodiment, the vacuum housing 2 is preferably spaced from contact with the blanket cylinder and extends only partially about the brush axis 19. A flow path 4 into fabric bag 6 is then generated by the compressed air line 8. In operation, dust and lint driven off the surface of the blanket cylinder are captured by the housing 2 and entrained into the flow 4 passing into and through the fabric bag 6.

Figure 11:
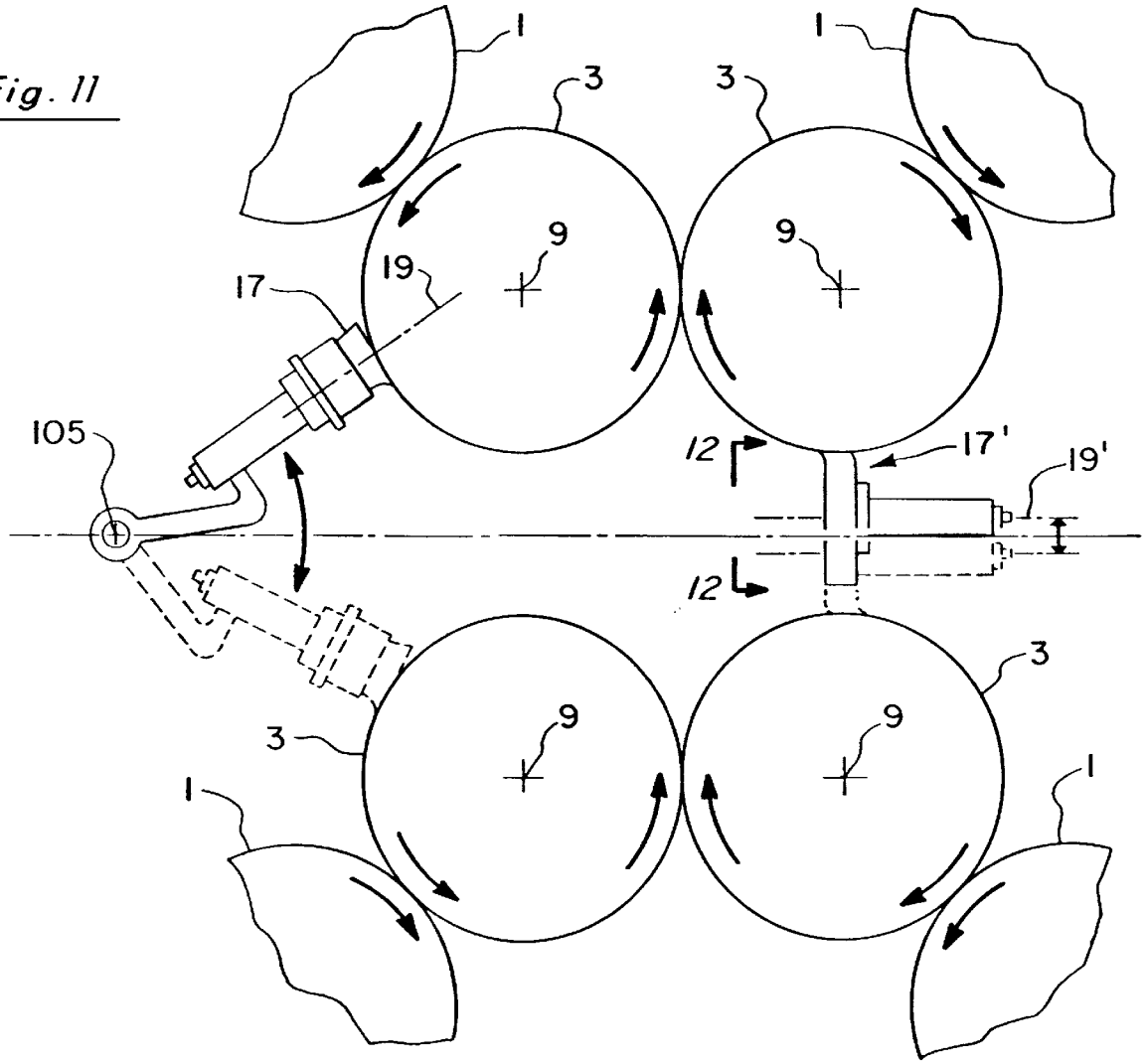
FIG. 11 illustrates an alternate brush design and an additional operational mode of the invention adapted to clean a deck unit of four plate cylinders and four blanket cylinders.

FIG. 11 illustrates an alternate brush design 17' on the right side and an additional operational mode of the invention adapted to clean a complete deck unit (i.e., arrangement of four plate cylinders 1 and four blanket cylinders 3). Brush 17' in FIGS. 11–13 like brush 17 of the preferred embodiments of FIGS. 1–10 has the projection of its rotational axis 19' (see FIG. 13) substantially perpendicular to the axes 9 of the blanket cylinders 3. Also like brush 17, brush 17' in FIG. 13 reciprocally moves along path 23 which is substantially parallel to the longitudinal axis 9 of the blanket cylinder 3. Similarly, the brush diameter 25' (e.g., ⅛, 1/10) of the length of the blanket cylinder 3. The actual contact portion 26 of the brush 17' in FIG. 12 is even a smaller fraction. However, unlike brush 17, the bristles of the brush 17' as shown in FIGS. 12 and 13 extend radially outwardly of the brush axis 19' at substantially 90 degrees. Additionally, the tip portions of the flexible bristles in the contact area (see FIG. 11) preferably flare out somewhat in the direction of rotation of the blanket cylinder 3 being cleaned. If desired, the bristles could be made stiff enough not to flare and the profile of the tip portions could be cut on a slant or curved to substantially match the profile of the surface of the blanket cylinder 3.

FIG. 11 also illustrates an adaptation of the invention to clean a deck unit of four plate cylinders 1 and four blanket cylinders 3 such as used in color printing. In such an array, one color is impressed by the lower pair of blanket cylinders 3 and another color by the upper pair. In actual operation, the lower pair of blanket cylinders 3 in FIG. 11 could be cleaned (as shown in dotted lines) on the fly as in FIG. 1 without interrupting the normal operation of the press. To do so, the brush 17 on the left in FIG. 11 would be pivoted clockwise about the axis 105 into the contact position shown in dotted lines. Similarly, the modified brush 17' on the right side of FIG. 11 would be vertically lowered (e.g., by any number of arrangements including one or more pistons or screws) into contact with the lower blanket cylinder 3 as also shown in dotted lines in FIG. 11. In contrast, the upper blanket cylinders 3 would be cleaned only after a press run of paper web 5 or when no ink was being transferred from the upper plate cylinders 1 to the upper blanket cylinders 3. This is true simply because the brushes 17 and 17' would otherwise be contacting the inked blanket cylinders 3 upstream or prior to the image being transferred to the paper web 5 and would smear it. The lower blanket cylinders 3 on the other hand are being contacted and cleaned downstream or after the image has been transferred to the web 5 and before the blanket cylinders 3 are re-inked by plate cylinders 1.

Figure 14:
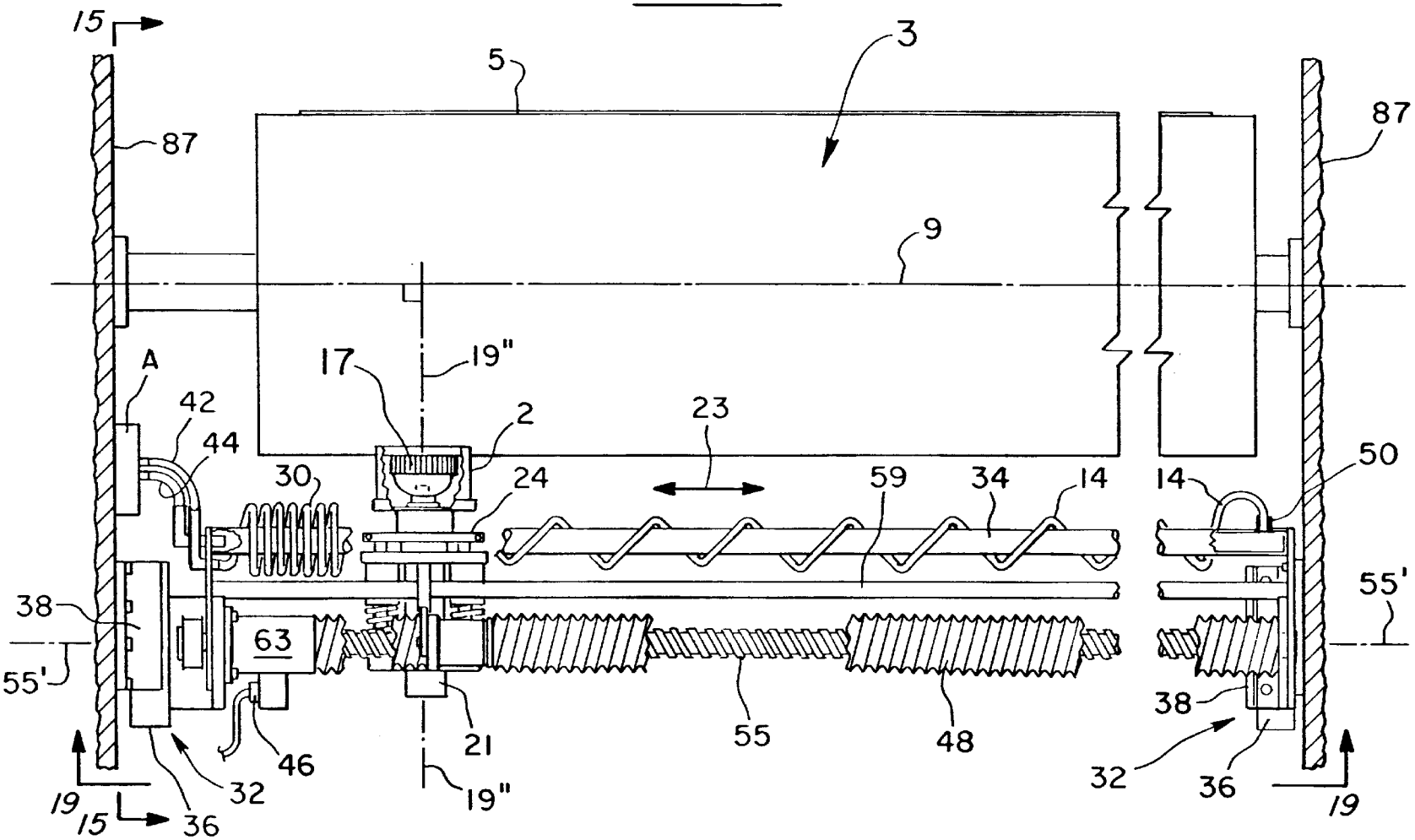
FIG. 14 is a view similar to FIG. 6 of another embodiment.
Figure 15:
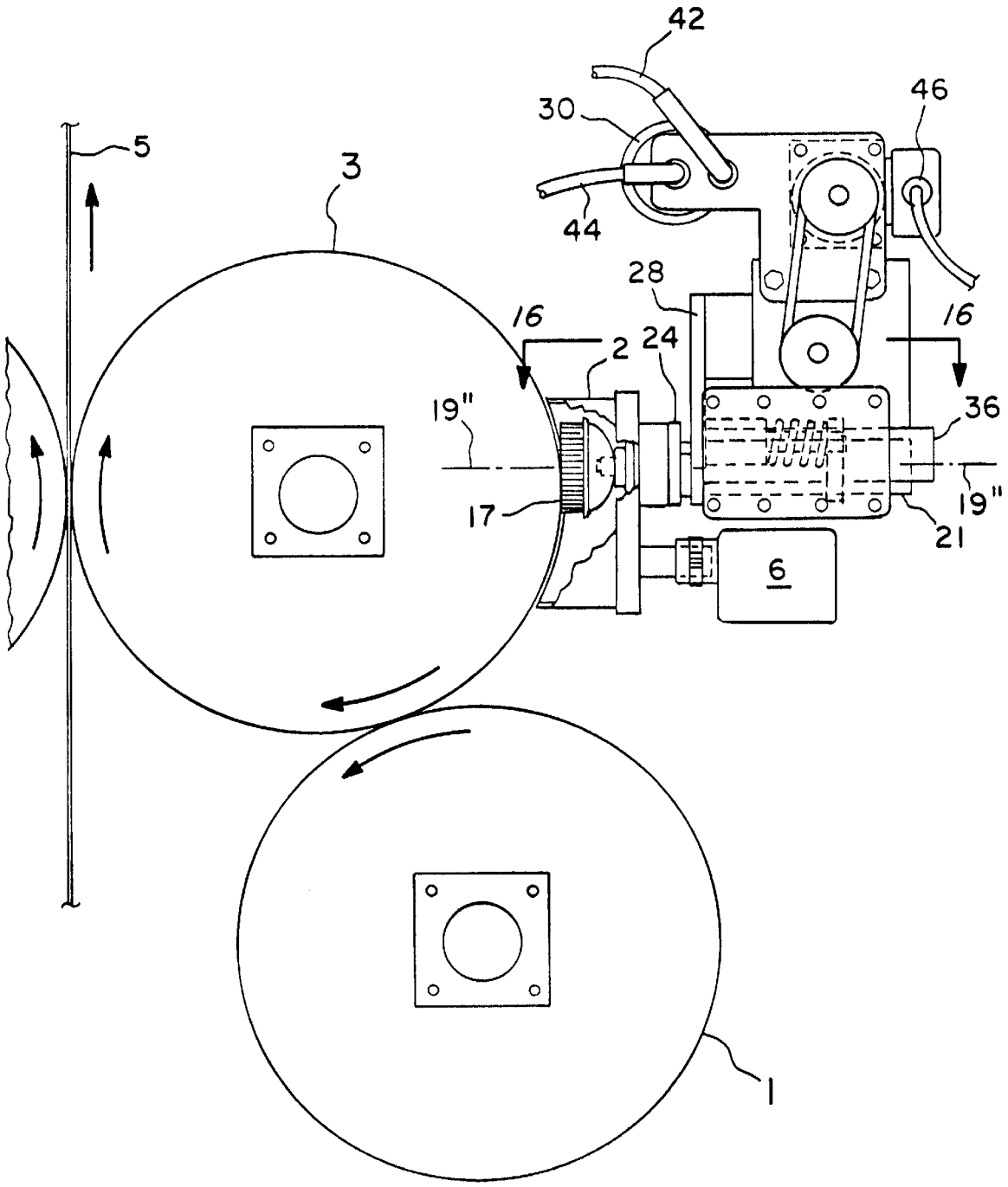
FIG. 15 is a view taken along line 15—15 of FIG. 14.

FIGS. 14–22 illustrate another preferred embodiment of the present invention. In it as best seen in FIG. 14, the cleaning member (e.g., brush 17) is reciprocally moved along a path 23 substantially parallel to the longitudinal axis 9 of the blanket cylinder 3. This is done by selectively activating the motor 63 to rotate the screw bar 55 much in the manner of the embodiment of FIG. 6. The brush 17 in the embodiment of FIGS. 14 and 15 is then preferably moved into and out of contact with the surface of the blanket cylinder 3 along its rotational axis 19".

Figure 16:
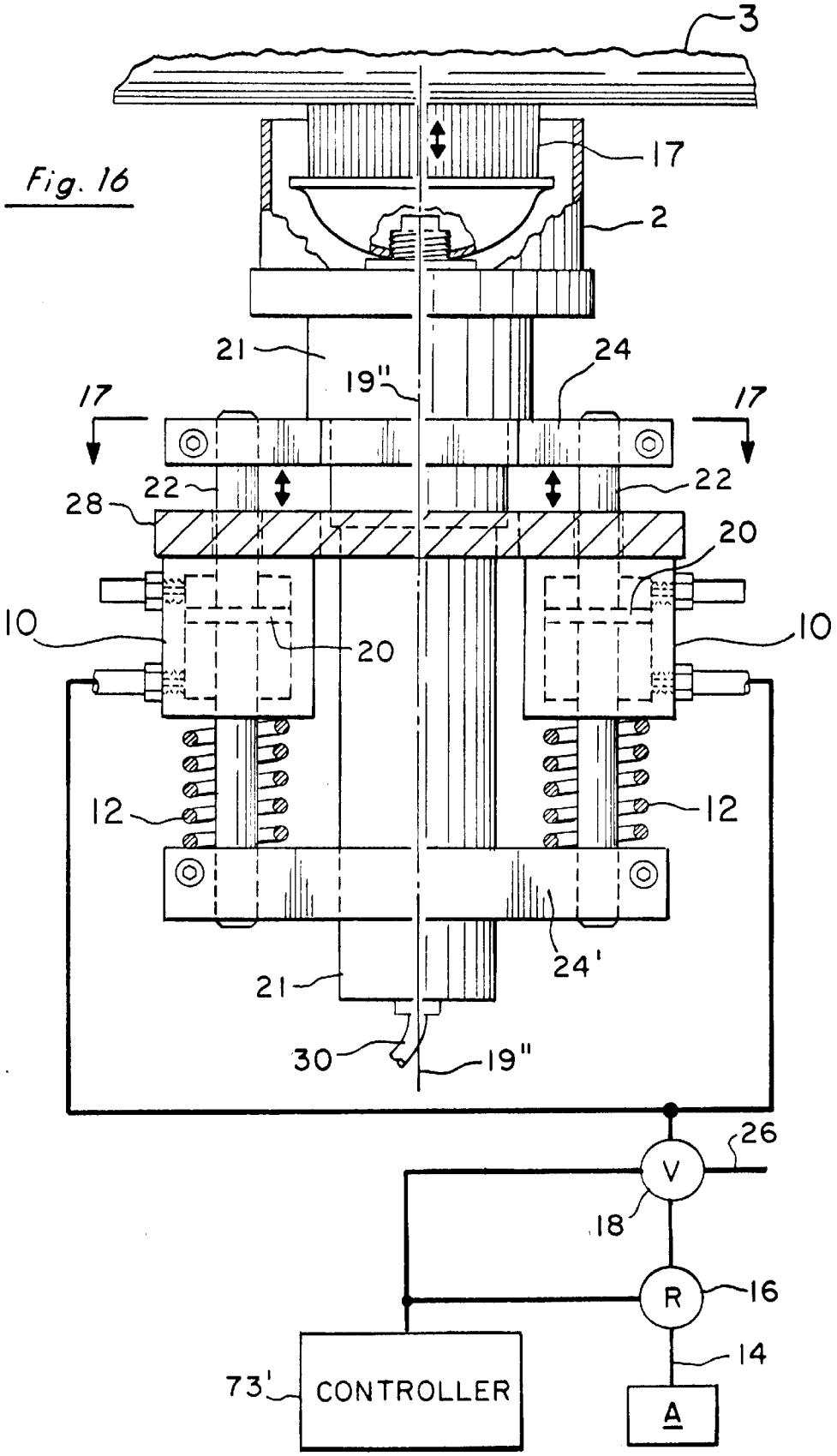
FIG. 16 is a view taken along line 16—16 of FIG. 15.
Figure 17:
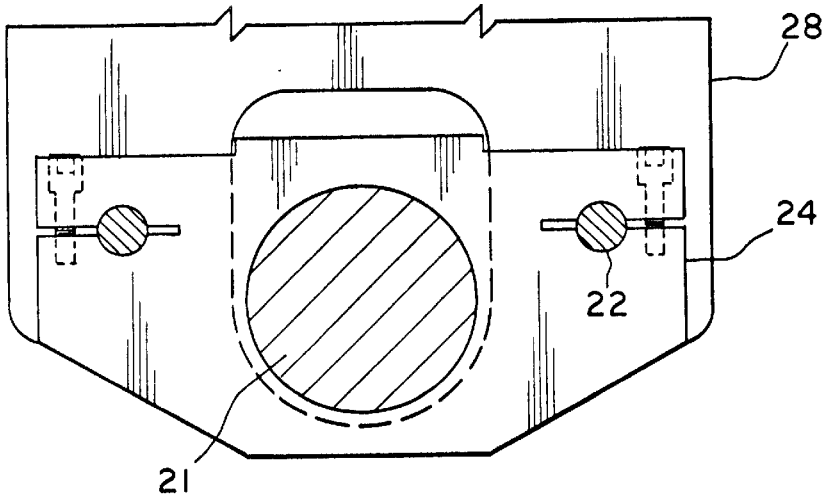
FIG. 17 is a view taken along line 17—17 of FIG. 16.

As shown in FIG. 16, this axial movement of the brush 17 along its rotational axis 19" is accomplished by an arrangement of pneumatic cylinders 10 working against return springs 12. More specifically, when a cleaning cycle is initiated by the control means 73', air under pressure in hose 14 passes from the source A through the pressure regulator 16 and opened valve 18 into the cylinders 10. The pressurized air works against the pistons 20 in each cylinder 10 to move the pistons 20, piston rods 22, crossbars 24 and 24', and the attached brush motor 21 forward along the axis 19" until the brush 17 contacts the surface of the blanket cylinder 3. This structure moves relative to the air cylinders 10 which are held stationary by support plate 28. In operation, the air regulator 16 is set at a predetermined pressure (e.g., 40 psi) that creates and maintains a predetermined contact pressure of the brush 17 on the surface of the blanket cylinder 3. This contact pressure is directly proportionally to the regulator pressure and is empirically determined for the optimum cleaning of the blanket cylinder 3. Too low a contact pressure will not adequately clean the surface of the blanket cylinder 3 and too high a pressure may unduly harm and prematurely wear out the surface of the blanket cylinder 3, which surface is typically a rubber or elastic layer. Once the desired contact pressure is determined, the regulator 16 is set at the pressure (e.g., 40 psi) to maintain this predetermined contact pressure. The rotating brush 17 in the arrangement of FIG. 16 is thus floating on the surface of the blanket cylinder 3 under the constant pressure of the regulator 16.

This floating feature is particularly advantageous because it is completely controlled by the set pressure of the regulator 16 and is independent of any variations in the surface of the blanket cylinder 3. Consequently, this predetermined contact pressure will be maintained all the way across the blanket cylinder 3 regardless of any surface variations. It is also independent of any variations or small misalignments of the blanket cylinder 3 and the structure that supports and moves the brush 17 across the blanket cylinder 3. Small misalignments, for example, of the axis 9 of the blanket cylinder 3 and the axis 55, of the drive screw 55 in FIG. 14 can then be tolerated without any loss in the cleaning efficiency of the brush 17. That is, the brush 17 will automatically move axially along 19" to maintain the contact pressure at the predetermined, desired level as set by the pressure regulator 16.

This pneumatic or floating arrangement of FIG. 16 also provides other operating advantages. For example, it automatically adjusts for any brush wear since it always moves the brush 17 to maintain the predetermined, desired contact pressure. It additionally makes replacing or changing out the brush 17 simply a matter of screwing off the worn brush 17 and screwing on a new brush 17, which can be done in a matter of minutes. No other adjustments are then necessary to compensate for any differences in the old and new brushes 17 as the floating pressure arrangement will do it automatically.

Moreover, the floating arrangement is a safety feature in that if the air supply should fail, the three-way valve 18 in FIG. 16 will automatically be moved by control means 73' to vent through line 26 wherein the brush motor 21 and brush 17 will be automatically and mechanically retracted along the axis 19 under the biasing force of return springs 12. This will move the brush 17 away from contact with the blanket cylinder 3. These return springs 12 additionally serve to retract the brush 17 in normal operation at the end of a cleaning operation when the valve 18 in FIG. 16 is closed by the control means 73' and the pressure in the cylinders 10 is vented through valve 18 and line 26.

Figure 18:
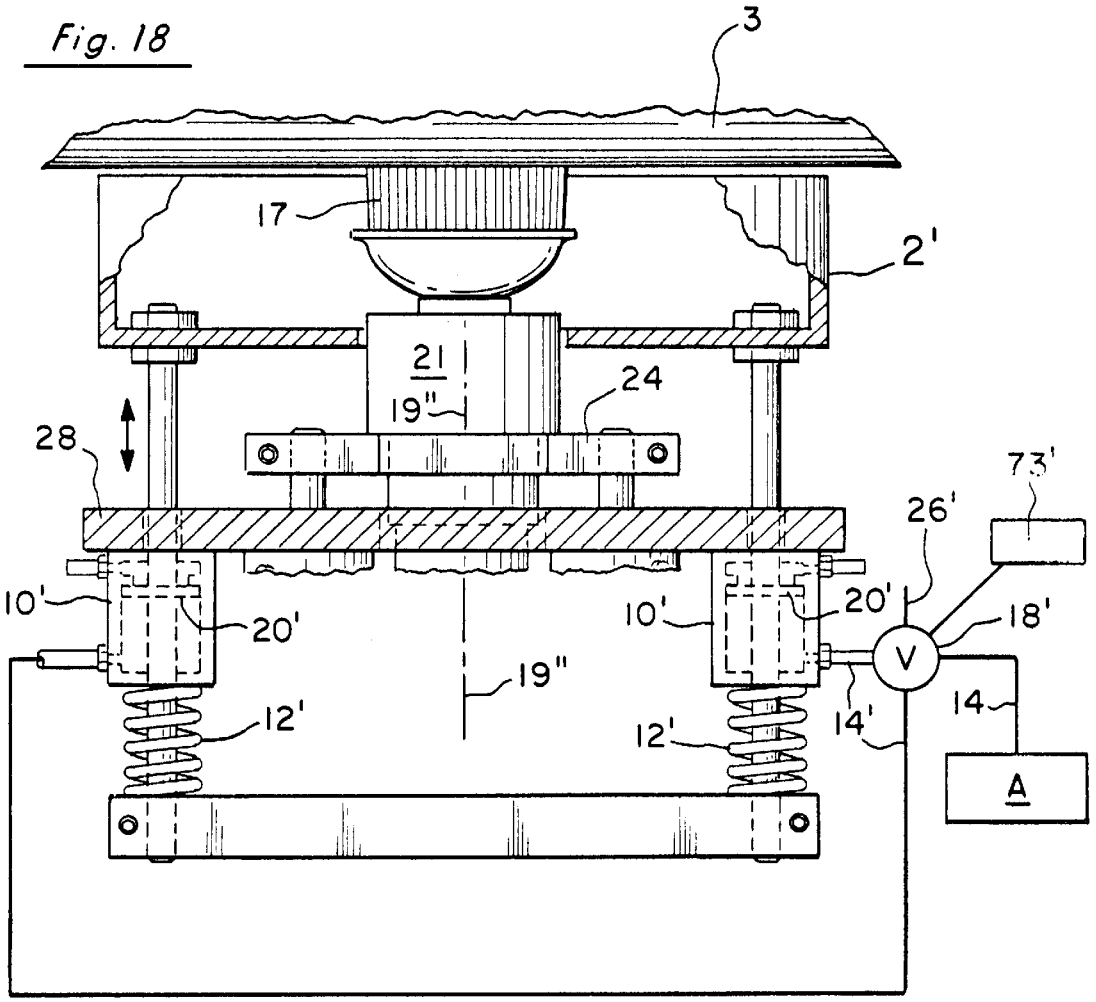
FIG. 18 is a top plan view of a modified support for the vacuum housing.

This safety feature can be further incorporated into the vacuum housing or shroud 2 of FIG. 16. That is, the housing 2 in the embodiment of FIG. 16 is mounted to and moves with the brush 17. However, in an alternative design as shown in FIG. 18, the vacuum housing or shroud 2' can be mounted to move along the axis 19" separately from the brush 17 and the pneumatic motor 21 for the brush 17. Using an arrangement similar to the one of FIG. 16, the housing 2' in FIG. 18 is supported by air cylinders 10' and return springs 12'. During the cleaning operation, the housing 2' in this arrangement is always positioned at a predetermined distance from the blanket cylinder 3 independent of the operation of the brush 17. That is, the pistons 20' in cylinders 10' are allowed to bottom out with this bottoming out spacing the housing 2' at a predetermined distance (e.g., ⅛ inch) from the surface of the blanket cylinder 3. Inward movement of the brush 17, for example, to raise the contact pressure or to allow for wear will not move the housing 2' any closer. Higher pneumatic pressure will also not move the housing 2' closer so the air hose 14' to the cylinders 10' need not be regulated and can be fed directly from the pressurized source a and line 14 at the full pressure (e.g., 100 psi) available on the site. Further, should the air pressure fail, the cylinder/spring arrangement of 10' and 12' of FIG. 18 will automatically retract the housing 2' along the axis 19" from the position of FIG. 18 in essentially the same manner as the brush 17 is retracted in FIG. 16.

Figure 19:
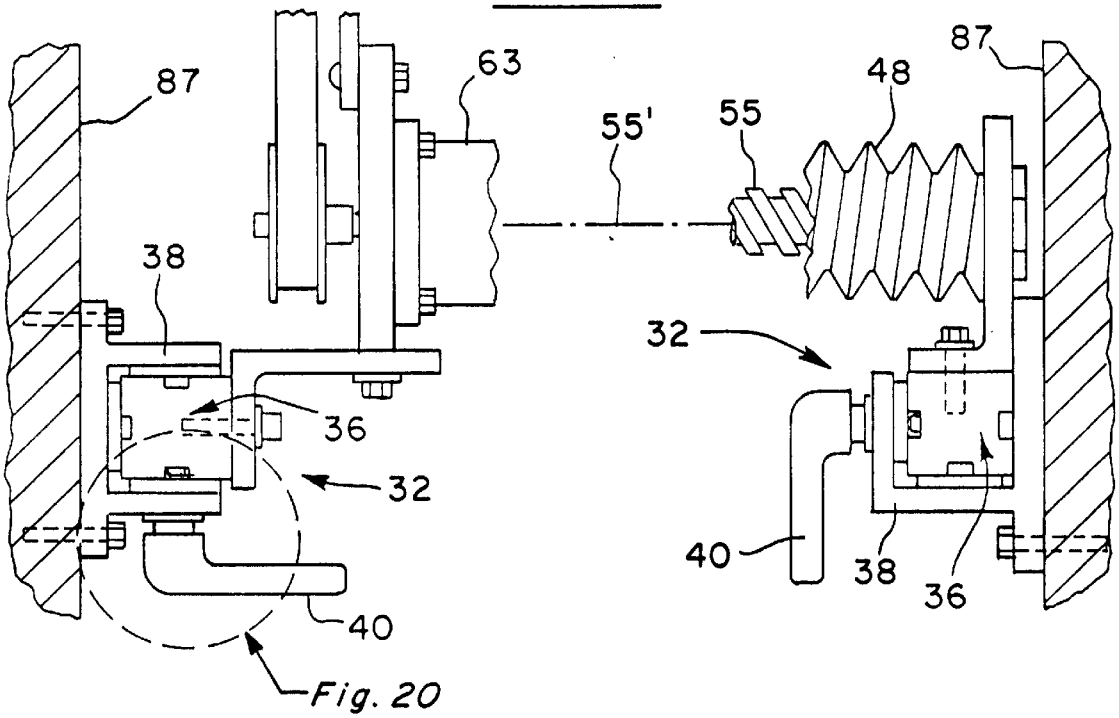
FIG. 19 is a view taken along line 19—19 of FIG. 14.
Figure 20:
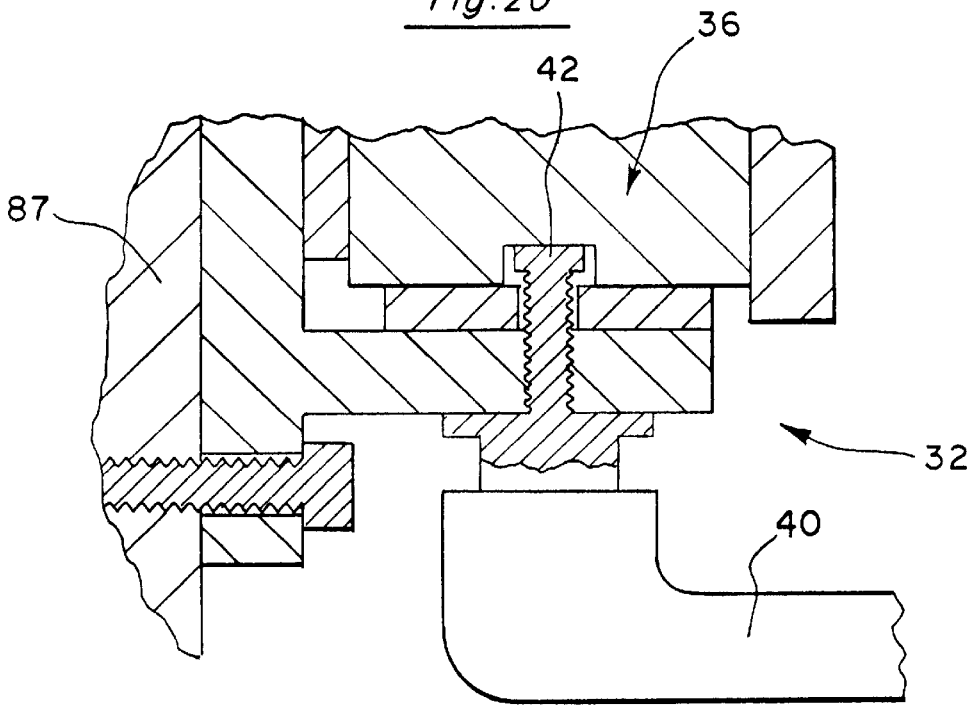
FIG. 20 is an enlarged view of the circled area in FIG. 19.

The cleaning system of FIG. 14 is preferably carried on a unitary or common support structure mounted to the walls 87 of the press by simple clamping arrangements such as 32 in FIGS. 14 and 19. In this manner, the entire structure of the cleaning system of FIG. 14 (including the brush 17, brush motor 21, vacuum housing 2, motor 63, screw bar 55, hollow air bar 34, stabilizing cross bar 59, and air hoses 14 and 30) can be mounted in place as a unit by a single clamp 32 on either side. Consequently, the entire cleaning system can be installed very quickly. This is done by merely sliding the ends 36 of the common, overall support structure for the cleaning system (see FIGS. 14 and 19) into the channels 38 on the press walls 87. Thereafter, it is only necessary to rotate each clamp arm 40 (see FIG. 20) to advance the screw head 142 tightly against the respective support end portion 36 to hold the entire cleaning system securely in place. Gross adjustments of the entire cleaning system toward or away from the blanket cylinder 3 can then be mechanically made by loosening the clamps 32 and moving the ends 36 of the unitary support structure relative to the channels 38 as desired. Such mechanical adjustments as discussed above can still be imprecise to some degree (e.g., axes 9 and 55' of the blanket cylinder 3 and common support structure slightly misaligned) as the floating, pneumatic arrangement of FIG. 16 for the brush 17 will automatically make the necessary adjustments to maintain the desired contact pressure of the brush 17.

The entire cleaning system can thus be installed very quickly and easily. More importantly, it can be quickly and easily removed for routine repairs to the press or in the case of an emergency. To do so, it merely requires disconnecting the various power lines to the cleaning unit (e.g., air hose feeds at 42 and 44 in FIG. 14 and the electrical plug 46 to the motor 63) and loosening clamps 32. The wrapping of the air hoses 14 and 30 in place about the bar 34 also adds to the compactness and safety of the cleaning unit as it is operating and while it is being installed or removed. Further, should the air hose 14 or 30 break, it will remain around the bar 34 and safely out of the operating parts of the press. Hose 30 to drive the brush motor 21 is removably connected as illustrated in FIG. 14 directly to the feed line 42 from the on site air source A. The other hose 14 to the cylinders 10 and 10' in FIGS. 16 and 18 is connected at 50 in FIG. 14 to the nipple on the far end of the hollow bar 34. The second feed line 44 in FIG. 14 is then removably connected to the opposite end of the bar 34 to pressurize the interior of the bar 34 and to supply air through the bar 34 to hose 14. The collapsible bellows 48 in FIG. 14 about the screw bar 55 help to keep dirt and other debris off the threads of the screw bar 55.

The overall, low profile of the cleaning system itself allows the press operator to see and repair many parts of the press without removing the unit. However, when necessary, the easy release of the cleaning unit permits its quick removal from the press. Once the repairs have been made, the quick re-installation keeps the loss of valuable press time to a minimum. In modern presses in which the trend is for shorter and shorter stacks or decks to reduce the overall size of the press (particularly its vertical size) and to move the decks closer to one another for better registry (particularly with color printing), the small size and easy installation/removal capabilities of the present invention are important features.

FIGS. 21 and 22 illustrate preferred modes in which the control means 73' moves the brush 17 during cleaning cycles. In the printing mode of FIG. 21, the press is being run with a full web of paper 5 in which images on adjacent blanket cylinder portions 150–153 are being transferred to the web 5. Each portion 150–153 typically represents a full page of print. In the printing mode of FIG. 22, less than the full width of the blanket cylinder 3 is being used as only a single page is being printed from portion 151 of the blanket cylinder 3. To clean the blanket cylinder 3 in the printing mode of FIG. 21, the brush 17 is preferably moved in a reciprocal manner along path 54 over the full width of the surface of the blanket cylinder 3. However, in the printing mode of FIG. 22 when less than the full width of the blanket cylinder 3 is being used, the control means 73' preferably only operates the brush 17 to move into engagement with the portion or portions actually being used. In the case of FIG. 22, the only portion being used is 151 to transfer an image to the single page web 5'. Consequently, the brush 17 preferably is only lowered to clean portion 151 as the brush 17 moves in path 54' across the full width of the blanket cylinder 3. Alternatively, the control means 73' could move the brush 17 just along path 54" (i.e., the width of portion 151 only). In any case, the brush 17 is preferably only moved into engagement with the blanket portion 151 (or other portions) actually being used and does not engage the portion (or portions) not being used.

The control 73' operates essentially like control 73. However, in an emergency (e.g., broken paper web sensed or if manually commanded), the control 73', will move the brush 17 out of contact with the blanket cylinder 3 and preferably hold the brush 17 in that position until the problem is corrected and the press is again up to speed and printing. The control 73' will then move the brush 17 to re-engage the blanket cylinder 3 at the location along the blanket cylinder 3 where the cleaning operation was previously interrupted to allow the brush 17 to complete its cleaning cycle.

While several embodiments of the present invention have been shown and described in detail, it is to be understood that various changes and modifications could be made without departing from the scope of the invention.

We claim:

1. In an offset printing press with a blanket cylinder extending along a longitudinal axis and having a plurality of portions thereof adjacent each other along said longitudinal axis, each portion having a width extending along the longitudinal axis of said blanket cylinder and being sized to carry an image substantially the size of a page, said press being selectively operable to print in at least a first printing mode and a second printing mode, said first printing mode transferring an image from each of a first number of said portions to a paper web substantially the size of said first number of portions and said second printing mode transferring an image from each of a second number of said portions to a paper web substantially the size of said second number of portions, said first number being at least one and being less than said second number of portions wherein the improvement includes:

means for selectively cleaning only said first number of portions of said blanket cylinder when said press is in said first printing mode and cleaning said second number of portions of said blanket cylinder when said press is in said second printing mode, said cleaning means cleaning substantially the entire width of each portion in each respective number of portions in the respective first and second printing modes.

2. The improvement of claim 1 wherein said cleaning means includes a cleaning member, means for moving said cleaning member over said plurality of adjacent portions of said blanket cylinder along a path substantially parallel to the longitudinal axis of said blanket cylinder, and means for selectively moving said cleaning member into and out of contact with said plurality of adjacent portions of said blanket cylinder, said means for selectively moving said cleaning member including control means operable in at least a first control mode and a second control mode, said first control mode moving said cleaning member into contact with only said first number of portions of said blanket cylinder when said press is in said first printing mode, said second control mode moving said cleaning member into contact with said second number of portions of said blanket cylinder when said press is in said second printing mode, said improvement further including means for continuously rotating said cleaning member about an axis during said first and second control modes when the cleaning member is respectively in contact with the respective first and second number of portions of the blanket cylinder.

3. The improvement of claim 2 wherein the axis of said rotating cleaning member is substantially perpendicular to the longitudinal axis of said blanket cylinder.

4. The improvement of claim 2 wherein said means for selectively moving said cleaning member reciprocally moves said cleaning member back and forth along said path in opposite directions over only said first number of portions in said first control mode.

5. The improvement of claim 2 wherein said means for selectively moving said cleaning member reciprocally moves said cleaning member back and forth along said path in opposite directions over said plurality of portions of said blanket cylinder in said first control mode.

6. The improvement of claim 1 wherein said cleaning member is a brush means.

7. A cleaning system for a blanket cylinder in an offset printing press, said blanket cylinder extending along a longitudinal axis and said system including means for mounting said blanket cylinder for rotation about said longitudinal axis thereof and means for rotating said blanket cylinder about said longitudinal axis, cleaning member, means for mounting said cleaning member for rotation about an axis, means for rotating said cleaning member about said rotational axis, means for moving said rotating cleaning member over the surface of said blanket cylinder along a path substantially parallel to the longitudinal axis of said blanket cylinder, and means for selectively moving said cleaning member into and out of contact with the surface of said blanket cylinder, and vacuum means for picking up material removed by said cleaning member from the surface of said blanket cylinder, said vacuum means including a housing substantially surrounding said cleaning member adjacent the surface of said blanket cylinder, means for selectively moving said housing toward and away from the surface of said blanket cylinder between first and second positions, said housing in said first position being closer to the surface of said blanket cylinder than in said second position, said moving means for said housing including means for mounting said housing for movement relative to said cleaning member between said first and second positions.

8. The cleaning system of claim 7 wherein said mounting means for said housing mounts said housing for movement relative to said cleaning member along the rotational axis of said cleaning member.

9. The cleaning system of claim 8 wherein said rotational axis of said cleaning member is substantially perpendicular to the longitudinal axis of said blanket cylinder.

10. The cleaning system of claim 7 wherein said moving means for said housing includes means for biasing said housing toward said second position.

11. The cleaning system of claim 7 wherein said moving means for said housing includes pneumatic means to move said housing to said first position.

12. The cleaning system of claim 11 further including means for biasing said housing toward said second position.

13. The cleaning system of claim 7 wherein said housing in said first position is spaced a predetermined distance from the surface of said blanket cylinder.

14. The cleaning system of claim 7 wherein said cleaning member is a brush means.

15. A removable cleaning system for a blanket cylinder in an offset printing press, said blanket cylinder extending along a longitudinal axis and said system including means for mounting blanket cylinder for rotation about said longitudinal axis thereof and means for rotating said blanket cylinder about said longitudinal axis, cleaning member, first means for mounting said cleaning member for rotation about an axis, second means for rotating said cleaning member about said rotational axis, third means for moving said rotating cleaning member over the surface of said blanket cylinder along a path substantially parallel to the longitudinal axis of said blanket cylinder, and fourth means for selectively moving said cleaning member into an out of contact with the surface of said blanket cylinder, and means for supporting said cleaning member and said first, second, third, and fourth means on a unitary support structure, said unitary support structure extending along an axis and having first and second end portions wherein said press includes means for releasably securing the respective end portions of said unitary support structure with the unitary support structure in a first position relative to said blanket cylinder with the axis of said unitary support structure substantially parallel to the longitudinal axis of said blanket cylinder, said unitary support structure of said cleaning member and said first, second, third, and fourth means being removable as a unit from said press by releasing said end portions of said unitary support structure from said securing means.

16. The removable cleaning system of claim 15 whereas said releasable securing means are clamps.

17. The removable cleaning system of claim 15 wherein at least one of said second, third, and fourth means is pneumatic and said system includes a bar extending substantially along the axis of said unitary support structure and a flexible, pneumatic hose extending along and about said bar between said one means and a pneumatic source of air under pressure.

18. The removable cleaning system of claim 17 wherein at least another of said second, third, and fourth means is pneumatic and said system includes a second pneumatic hose extending along and about said bar between said another means and said pneumatic source of air under pressure.

19. The removable cleaning system of claim 17 wherein said bar is hollow and the interior of said bar is connected to said pneumatic source at one end of said bar and at least one of said hoses is connected to said bar at the other end of said bar.

20. The removable cleaning system of claim 15 wherein said third means includes a screw bar, bellows, and means for mounting said bellows about said screw bar.

21. A cleaning system for removing dust and lint from a blanket cylinder in an offset printing press during a printing run without using liquid cleaners and without interrupting the printing run, said offset printing press including a plate cylinder, said blanket cylinder, and a paper web, said plate cylinder having an image thereon and said offset printing press including means for mounting said plate cylinder, blanket cylinder, and paper web to transfer the image from said plate cylinder to said blanket cylinder and from said blanket cylinder to said paper web during said printing run, said blanket cylinder extending along a longitudinal axis and said cleaning system further including means for rotating said blanket cylinder about said longitudinal axis thereof at a first rotational rate during said printing run of said offset printing press with the image on said plate cylinder being transferred to said blanket cylinder and onto said paper web, cleaning member, means for mounting said cleaning member for rotation about an axis with at least a first portion of said cleaning member at any one time contacting the surface of said blanket cylinder, means for rotating said cleaning member about said rotational axis, and means for moving said rotating cleaning member across the surface of said blanket cylinder along a path substantially parallel to the longitudinal axis of said blanket cylinder with at least said first portion of said cleaning member in contact with the surface of said blanket cylinder wherein said means for moving said rotating cleaning member moves said rotating cleaning member across the surface of said blanket cylinder on the fly during an uninterrupted printing run of said press with said blanket cylinder rotating at said first rotational rate with the image on said plate cylinder being transferred to said blanket cylinder and onto said paper web, said press having normal operating parameters and control means including means for sensing at least one of said normal operating parameters, means for automatically activating said control means to move said cleaning member away from a contact location with the surface of the blanket cylinder in response to sensing a deviation from said at least one of said normal operating parameters, and means for thereafter re-engaging said cleaning member with the surface of said blanket cylinder substantially at said location to resume the cleaning operation.

* * * * *